US008085283B2

(12) United States Patent
Ahn et al.

(10) Patent No.: US 8,085,283 B2
(45) Date of Patent: Dec. 27, 2011

(54) DATA PROCESSING APPARATUS, LIQUID CRYSTAL DISPLAY APPARATUS COMPRISING THE SAME AND CONTROL METHOD THEREOF

(75) Inventors: Ik-hyun Ahn, Cheonan-si (KR); Jong-hyon Park, Cheonan-si (KR); Jun-pyo Lee, Cheonan-si (KR)

(73) Assignee: Samsung Electronics Co., Ltd. (KR)

( * ) Notice: Subject to any disclaimer, the term of this patent is extended or adjusted under 35 U.S.C. 154(b) by 654 days.

(21) Appl. No.: 12/249,660

(22) Filed: Oct. 10, 2008

(65) Prior Publication Data

US 2009/0128586 A1 May 21, 2009

(30) Foreign Application Priority Data

Nov. 15, 2007 (KR) ..... 10-2007-0116704

(51) Int. Cl.
*G09G 5/10* (2006.01)

(52) U.S. Cl. ..... 345/690

(58) Field of Classification Search ..... 345/690
See application file for complete search history.

(56) References Cited

U.S. PATENT DOCUMENTS

| | | | | |
|---|---|---|---|---|
| 6,943,763 | B2 * | 9/2005 | Shibata et al. | 345/89 |
| 7,145,534 | B2 * | 12/2006 | Ham | 345/87 |
| 2006/0022924 | A1 * | 2/2006 | Kim et al. | 345/89 |

* cited by examiner

*Primary Examiner* — Richard Hjerpe
*Assistant Examiner* — Sahlu Okebato
(74) *Attorney, Agent, or Firm* — Innovation Counsel LLP

(57) ABSTRACT

A data processing apparatus which revises n-bit image data, includes a frame memory which stores therein n−m bit image data of a previous frame; a memory interface which outputs n-bit revision data including upper n−m bits having n−m bit image data of the previous frame outputted by the frame memory and lower m bits having fixed data corresponding to a decimal value 1; a first reviser which revises a color temperature of current frame image data by using n-bit image data of a current frame and the revision data; and a second reviser which revises a gray scale of the current frame image data by using the image data outputted by the first reviser and the revision data.

16 Claims, 7 Drawing Sheets

DATA PROCESSING APPARATUS, LIQUID CRYSTAL DISPLAY APPARATUS COMPRISING THE SAME AND CONTROL METHOD THEREOF

CROSS-REFERENCE TO RELATED APPLICATION

This application claims priority from Korean Patent Application No. 10-2007-0116704, filed on Nov. 15, 2007, in the Korean Intellectual Property Office, the disclosure of which is incorporated herein by reference.

BACKGROUND OF THE INVENTION

1. Field of the Invention

Apparatuses and methods consistent with the present invention relate to a data processing apparatus, a liquid crystal display apparatus comprising the same and a control method thereof, and more particularly, to a data processing apparatus which revises image data and which includes a frame memory, a liquid crystal display apparatus comprising the same and a control method thereof.

2. Description of the Related Art

A liquid crystal display apparatus which displays images on a liquid crystal panel receives image data and revises a color temperature or a gray scale level of the image data by comparing previous frame image data to current frame image data. A frame memory is used to store therein one frame of image data. In order to take less capacity of the memory, the number of bits of stored image data is smaller than the number of bits of the received image data.

The image data corresponding to the unstored bits is replaced by other image data. Such a change in the image data causes an error, e.g. a vertical line in a liquid crystal panel.

The error occurs during a DCC (dynamic capacitance compensation) process of revising a gray scale level of image data. DCC changes a data voltage applied to a display panel depending on a gray scale difference between a previous frame and a current frame and adds a further change to improve response time. The larger the difference between the previous frame image data and current frame image data, the larger the further change applied to the data voltage. The error is exacerbated as the frequency of the frame image becomes larger and when an image signal is a video signal.

SUMMARY OF THE INVENTION

Accordingly, it is an aspect of the present invention to provide a data processing apparatus which reduces image errors while revising image data, a liquid crystal display apparatus comprising the same and a control method thereof.

Also, it is another aspect of the present invention to provide a data processing apparatus in which the capacity of a frame memory is decreased, a liquid crystal display apparatus comprising the same and a control method thereof.

Further, it is another aspect of the present invention to provide a data processing apparatus which prevents the occurrence of an error during revision of a gray scale, a liquid crystal display apparatus comprising the same and a control method thereof.

Additional aspects and/or advantages of the present invention will be set forth in the description which follows, or will be obvious from the description, or may be learned by practice of the present invention.

The foregoing and/or other aspects of the present invention are also achieved by providing a data processing apparatus which receives n-bit image data, comprising: a frame memory which stores therein n−m bit image data of a previous frame; a memory interface which outputs n-bit revision data including upper n−m bits having n−m bit image data of the previous frame outputted by the frame memory and lower m bits having fixed data corresponding to a decimal value 1; a first reviser which revises a color temperature of current frame image data by using n-bit image data of a current frame and the revision data; and a second reviser which revises a gray scale of the current frame image data by using the image data outputted by the first reviser and the revision data.

According to an embodiment of the present invention, the first reviser comprises a data extension part which generates an offset value having a larger number of bits than n bits from n−m bit image data of the current frame and generates an offset difference value corresponding to a difference between the offset value and an offset value of the previous frame; an interpolation part which outputs interpolation data according to a following formula based on the offset value and the offset difference value;

interpolation data=offset value+{offset difference value*fixed data*$(1/2^m)$*$(2^m-1)/2$}, and a dithering part which converts the number of bits of the interpolation data into $n$ bits and outputs the converted interpolation data as image data outputted by the first reviser. [Formula 1]

According to an embodiment of the present invention, the n bits comprise 10 bits, and the frame memory stores therein 8 bit image data.

According to an embodiment of the present invention, the number of bits of the offset value comprises 12.

According to an embodiment of the present invention, the data processing apparatus further includes a revision determiner which determines an identity between n−m bit image data of the current frame and n−m bit image data of the previous frame, and disables the second reviser if it is determined that the n−m bit image data of the current frame is identical with that of the previous frame.

According to an embodiment of the present invention, the revision determiner outputs a control signal to the second reviser to control whether to enable the second reviser, and the control signal is synchronized with the image data outputted from the first reviser to the second reviser.

According to an embodiment of the present invention, the second reviser revises a gray scale of image data by using overshoot driving or undershoot driving.

Another embodiment of the present invention provides a liquid crystal display apparatus which receives and displays n-bit image data, the liquid crystal display apparatus comprising: a frame memory which stores therein n−m bit image data of a previous frame; a data controller which has a memory interface to output n-bit revision data having upper n−m bits including n−m bit image data of the previous frame outputted by the frame memory and lower m bits including fixed data corresponding to a decimal value 1, a first reviser to revise a color temperature of image data of a current frame by using n-bit image data of a current frame and the revision data and a second reviser to revise a gray scale of current frame image data by using the image data outputted by the first reviser and the revision data; and a liquid crystal panel which displays thereon image data outputted by the data controller.

BRIEF DESCRIPTION OF THE DRAWINGS

The above and/or other aspects of the present invention will become apparent and more readily appreciated from the following description of the embodiments, taken in conjunction with the accompanying drawings of which.

DETAILED DESCRIPTION OF EXEMPLARY EMBODIMENTS

Hereinafter, exemplary embodiments of the present invention are described with reference to accompanying drawings, wherein like numerals refer to like elements and repetitive descriptions will be avoided as unnecessary.

Figure 1:
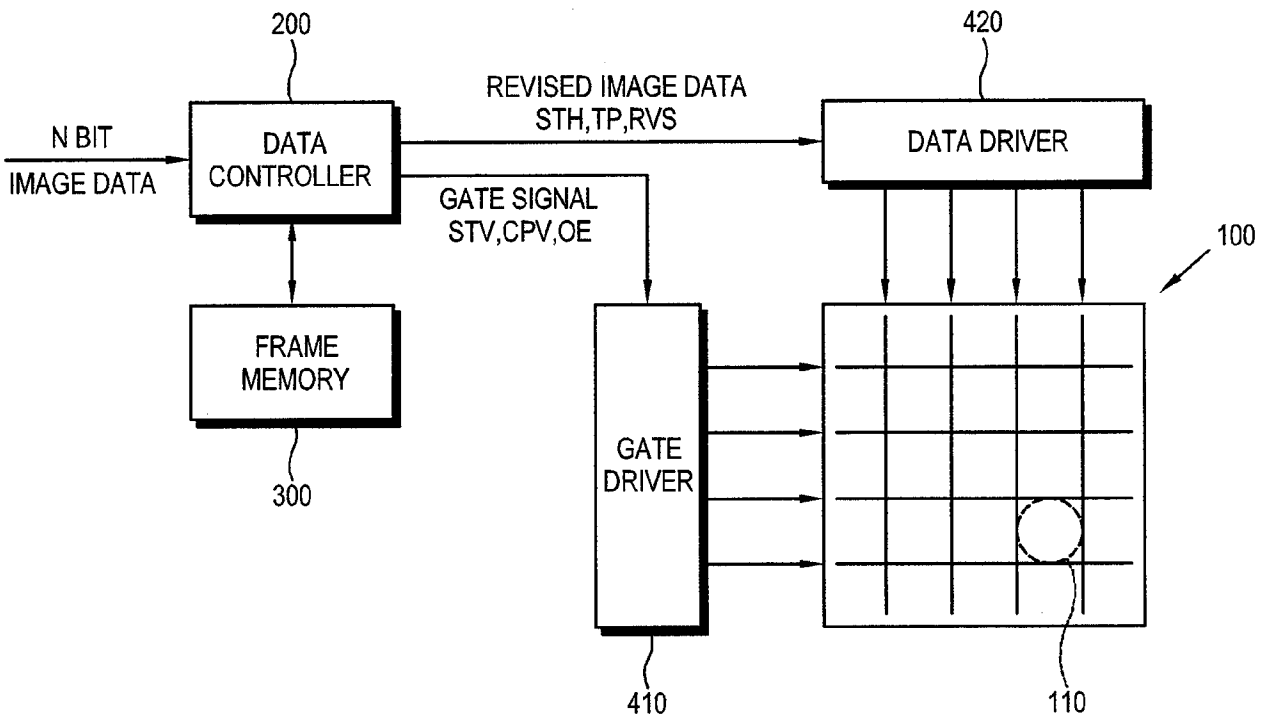
FIG. 1 is a control block diagram of a liquid crystal display apparatus according to a first exemplary embodiment of the present invention.

FIG. 1 is a control block diagram of a liquid crystal display apparatus according to a first exemplary embodiment of the present invention.

A liquid crystal display apparatus according to the present embodiment includes a liquid crystal panel 100, a gate driver 410, a data driver 420, a data controller 200 and a frame memory 300. The liquid crystal display apparatus receives n-bit image data from an external source such as a computer or a broadcasting station, and displays an image, defined by the image data, on the liquid crystal panel 100.

The liquid crystal panel 100 includes two insulating substrates, a lower insulating substrate and an upper insulating substrate, having a liquid crystal layer disposed therebetween (not shown). A plurality of pixels 110 is formed in a rectangular matrix pattern on the lower insulating substrate.

Figure 2:
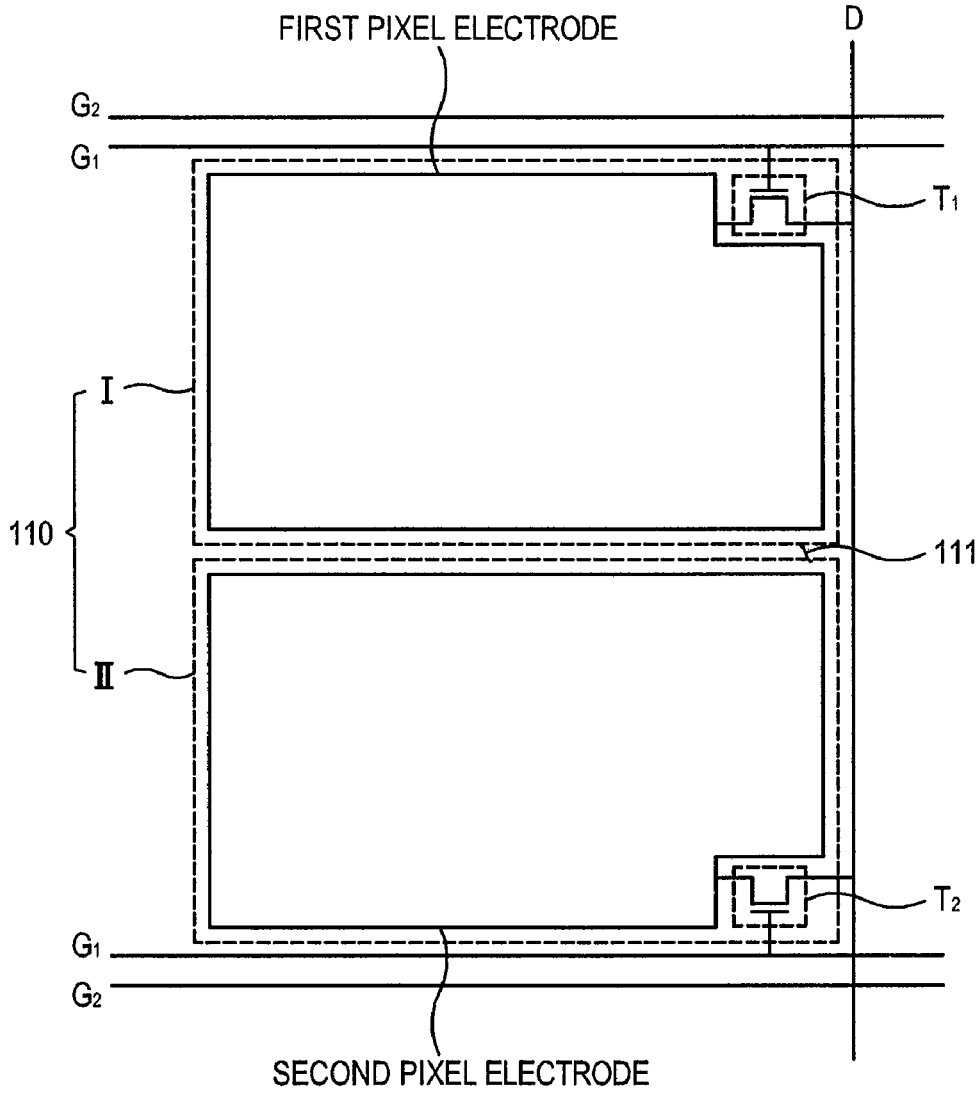
FIG. 2 illustrates a pixel according to the first exemplary embodiment of the present invention.

As shown in FIG. 2, a single pixel 110 is defined by first and second gate lines G1 and G2 extending in a first direction and a data line D crossing the first and second gate lines G1 and G2. The pixel 110 is rectangular and includes two sub pixels I and II which are divided by a cutting pattern 111. The liquid crystal display apparatus is driven in an SPVA (super patterned vertically aligned) mode in which a single pixel 110 is divided into a plurality of regions and in which individual regions in the plurality of regions may receive different data voltages based on different image data in order to improve lateral visibility.

A first thin film transistor T1 is formed at an intersection between the first gate line G1 and the data line D. The first thin film transistor T1 is connected to a first pixel electrode. A second thin film transistor T2 is formed at an intersection between the second gate line G2 and the data line D. The second thin film transistor T2 is connected to a second pixel electrode. Each of the thin film transistors T1 and T2 receives data voltages based on image data having different levels of a gray scale through the data line D.

The pixel 110 has a rectangular shape, but is not limited thereto. Alternatively, the shape of the pixel 110 may be other than rectangular.

The pixel 110 may include a single, uncut pixel electrode, or may include three or more cut pixel electrodes, for each of which there is provided a thin film transistor. Also, each of the plurality of cut pixel electrodes may receive the same data voltage based on the same image data. If the same data voltage based on the same image data is applied to each of the cut pixel electrodes, values of the capacitance of individual cut pixel electrodes may be selected to change the gray scale level of voltage stored on individual cut pixel electrodes from the gray scale level of the voltage supplied by the data driver based on the image data.

A common electrode is formed on the upper insulating substrate and the liquid crystal layer is disposed between the common electrode and the pixel 110. The alignment of liquid crystal molecules is adjusted by the image data and by the associated data voltage applied to the subpixels I and II of the pixel 110 and by a common voltage applied to the common electrode, to thereby display an image on the liquid crystal panel 100. According to the present embodiment, the liquid crystal panel 100 displays at least 120 frame images per second, that is to say the frequency of the frame image is at least 120 frames per second. The magnitude of the gray scale revision performed by a second reviser 230 is adjusted depending on the frequency of the frame image. The larger the frequency of the frame images, the larger is the gray scale revision, and the higher or the lower the gray scale level of the image data and the associated data voltage applied to the pixel 110 is.

The gate driver 410 is also called a scan driver. The gate driver applies a gate signal combining a gate on voltage Von and a gate off voltage Voff to the gate lines G1 and G2.

The data driver 420 is also called a source driver. The data driver 420 converts image data that is outputted by the data controller 200 into a data voltage, and supplies the data voltage to the pixels electrodes I and II in the pixel 110 through the data line D.

The frame memory 300 stores image data of a previous frame and supplies the image data of the previous frame to the data controller 200 for use by the data controller 200 in revising image data of a current frame. The frame memory 300 does not store all of the n-bit image data of the previous frame, but stores only the image data of the upper n−m bits.

The data controller 200 includes a control block (not shown) which is also called a timing controller. The data controller 200 outputs various control signals to the gate driver 410 and the data driver 420, and revises image data which the data controller receives from an external source (not shown). The data controller 200 outputs a vertical synchronization start signal STV, a gate clock signal CPV for controlling an output timing of a gate on signal and a gate on enable signal OE for limiting a width of a gate on signal, to the gate driver 410.

The data controller 200 outputs revised image data, a horizontal synchronization start signal STH, a load signal LOAD or TP to apply a data voltage to the data line D corresponding to the revised image data, a reverse control signal RVS to reverse the polarity of a data voltage, a horizontal clock signal, etc. to the data driver 420.

Figure 3:
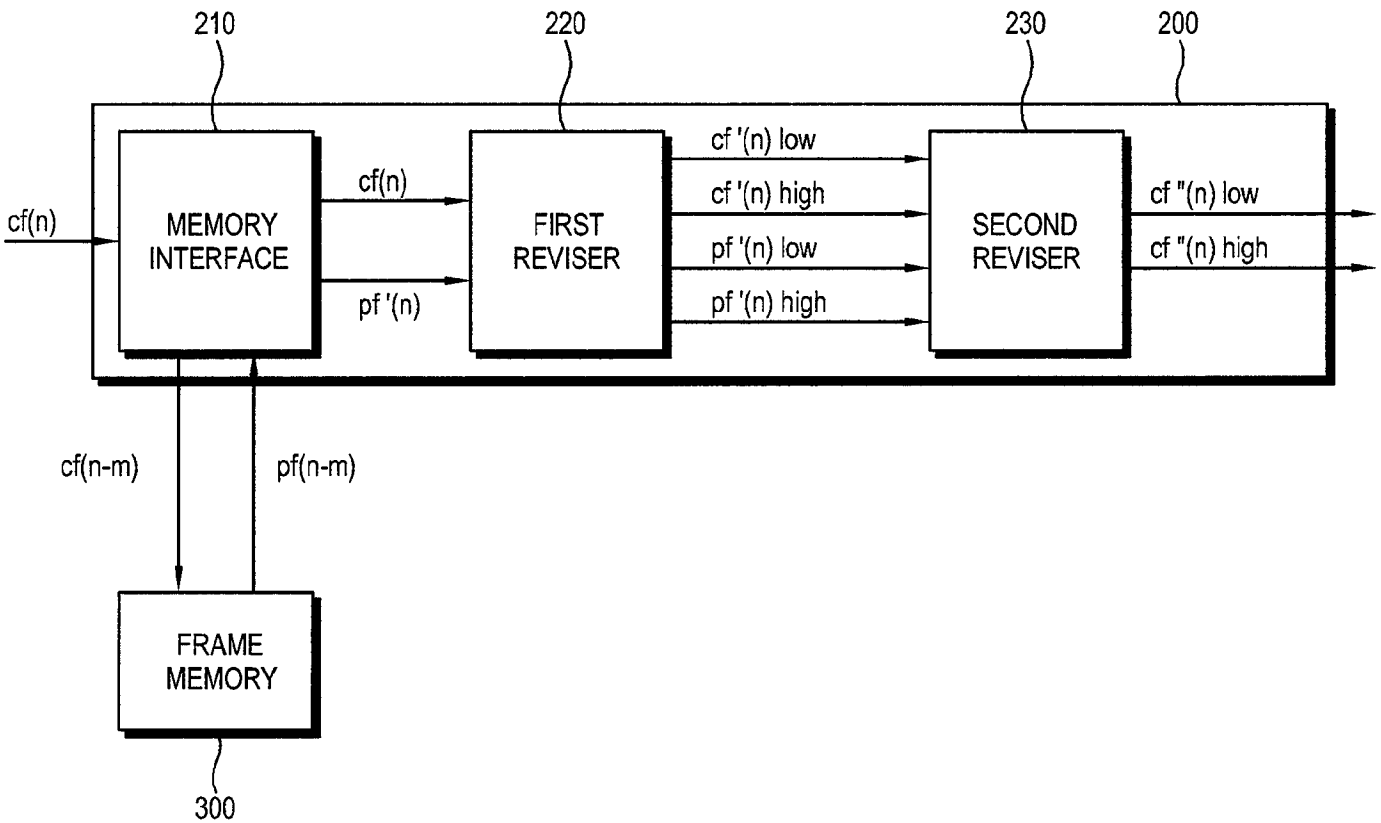
FIG. 3 is a control block diagram of a data processing apparatus according to the first exemplary embodiment of the present invention.

FIG. 3 is a detailed control block diagram of a data processing apparatus for revising image data according to a first exemplary embodiment of the present invention. The data processing apparatus 320 includes the data controller 200 and the frame memory 300. As shown in FIG. 3, the data controller 200 includes a memory interface 210, a first reviser 220 and the second reviser 230 that revise image data. The data controller 200 further includes a driving signal generator (not shown) that generates a plurality of driving signals for application to the gate driver 410 and the data driver 420.

The memory interface 210 communicates with the frame memory 300, receives image data of a previous frame from the frame memory 300 and generates revision data that is derived from the received image data of the previous frame.

Hereinafter, the image data corresponding to a current frame is called cf (current frame) image data, and the image data corresponding to a previous frame is called pf (previous frame) image data. In drawings, cf refers to cf image data, pf refers to pf image data, and letters in round brackets refer to the number of bits of image data.

The memory interface 210 receives cf image data cf(n) from an external source of image data (not shown). As described above, the frame memory 300 stores therein pf image data pf(n−m) for use in revising a color temperature and a gray scale of the cf image data cf(n). As shown in FIG. 3, currently-inputted cf image data cf(n) is inputted to the first reviser 220 through the memory interface 210 and at the same time the upper n−m bits of the cf image data cf(n−m) are stored in the frame memory 300. When the cf image data cf(n−m) is inputted to the frame memory 300, the pf image data pf(n−m) is outputted to the memory interface 210. The memory interface 210 combines fixed data with the pf image data pf(n−m) to generate new revision data pf'(n) and outputs the revision data pf'(n) to the first reviser 220.

Figure 4:
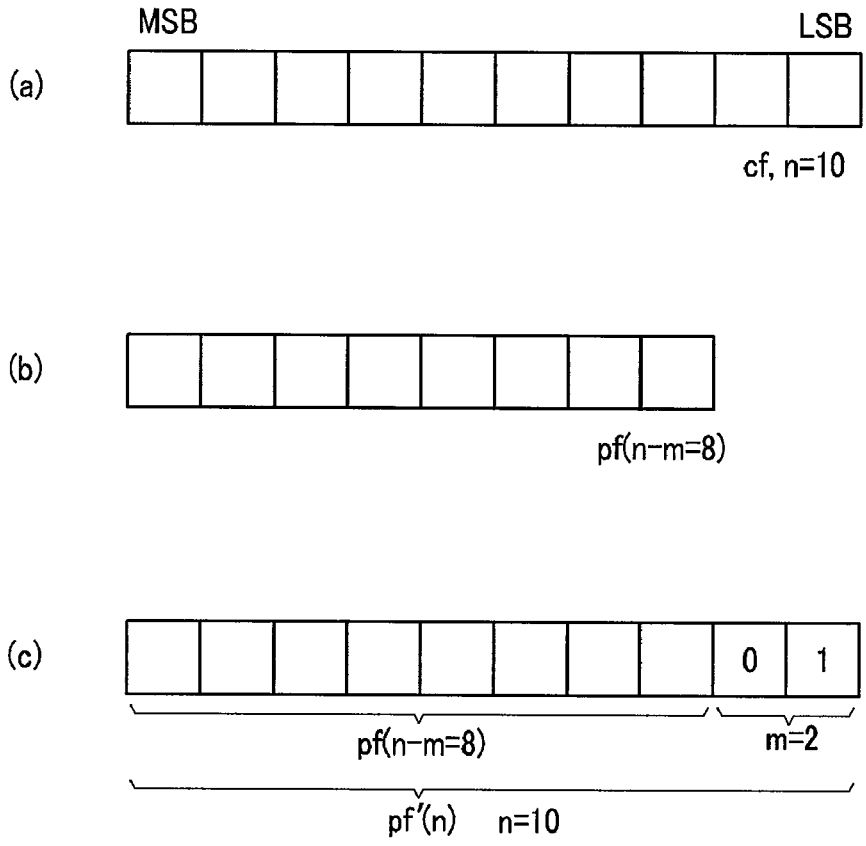
FIG. 4 illustrates the number of bits of image data according to the first exemplary embodiment of the present invention.

FIG. 4 illustrates the number of bits of the cf image data cf(n), the number of bits of the stored pf image data pf(n−m) and the number of bits of the revision data pf'(n). In FIG. 4, (a) refers to cf image data cf(n) having n bits received from an external source and (b) refers to pf image data pf(n−m) having n−m bits that is stored in the frame memory 300. If the number of bits of the stored image data pf(n−m) is increased, the capacity of the memory should increase accordingly. Thus, manufacturing costs of the data processing apparatus and the liquid crystal display apparatus rise. Typically, image data which has a smaller number of bits than the cf image data cf(n) is stored in the frame memory 300. For example, if the cf image data cf(n) is 10 bit data, the frame memory 300 may receive the upper n−m bits of cf image data cf(n−m) and store this image data for retrieval later as pf data pf(n−m) where n−m is 8, a number of bits that is smaller than 10 bits.

The memory interface 210 according to the present embodiment generates the revision data pf'(n) as in (c) in FIG. 4. The upper n−m bits of the revision data pf'(n) includes the upper n−m bit image data of the pf image data pf(n−m) received by the memory interface 210 from the frame memory 300, and the lower m bits of the revision data pf'(n) are set to correspond to a decimal value 1. The lower m bits refer to the fixed data. That is, if m is 2, the fixed data is 01. If m is 3, the fixed data is 001.

In a conventional data processing apparatus, revision data pf'(n), that is inputted to the first reviser to revise cf image data cf (n), includes upper n−m bit image data of the pf image data pf(n−m) retrieved from the frame memory and the lower m bits of current frame image data. In this case, a difference between the lower m bits of the pf image data, and the lower m bits of revision data pf'(n) is increased while passing through the revisers, particularly the second reviser 230 that is used for revising the gray scale. Such a difference causes an image error such as a vertical line in a liquid crystal panel when an image displayed on the liquid crystal panel is scrolled left and right. The difference between the lower m bits of the pf image data and the lower m bits of the revision data pf'(n) is in a range determined by $2^m$, and the difference value ranges from a minimum of $-(2^m-1)$ to a maximum of $+(2^m-1)$, that is a range of $\pm(2^m-1)$, which corresponds to a maximum difference absolute value of $(2^m-1)$ and the minimum value 0 of m bits. For example, if m is 2, the difference may range from −3 to +3. If m is 3, the difference may be a maximum of ±7. The larger the difference is, the clearer the vertical line image error is.

According to the present embodiment of the present invention, the lower m bits of the revision data pf'(n) are made equal to the m bit fixed data to reduce the difference between the revision data pf'(n) and the pf image data. The memory interface 210 generates the revision data pf'(n) having n bits by multiplying $2^m$ by n−m bit pf image data pf(n−m) and by adding m bit fixed data thereto.

According to the present embodiment of the present invention, an offset difference value is multiplied by a half of the maximum difference absolute value of $(2^m-1)$, i.e. $(2^m-1)/2$ for reducing the difference between the lower m bits of the pf image data and the lower m bits of the revision data pf(n) during an interpolating process. This is described more detail in the description of an interpolation part 223 as follows.

The n-bit revision data pf'(n) and the n-bit cf image data cf(n) are inputted to the first reviser 220.

Figure 5:
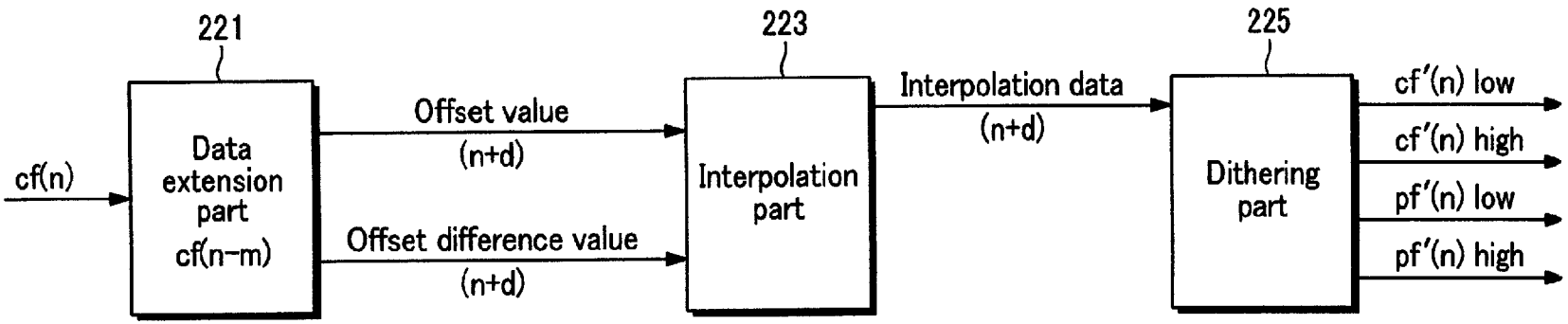
FIG. 5 is a control block diagram of a first reviser according to the first exemplary embodiment of the present invention.

The first reviser 220 includes an ACC (accurate color correction) block (not shown) which revises a color temperature of the cf image data cf(n). FIG. 5 is a control block diagram of the first reviser 220. As shown therein, the first reviser 220 includes a data extension part 221, an interpolation part 223 and a dithering part 225. The first reviser 220 extends the number of bits of inputted image data and stores the image data having the extended number of bits, generates interpolation data also having the extended number, dithers the interpolation data having the extended number of bits and outputs the n-bit revision data and n-bit first revision image data.

When the cf image data cf(n) is inputted to the data extension part 221, only the upper n−m bits of the cf image data cf(n−m) is extended to (n+d) bit image data and stored in the data extension part 221. The data extension part 221 includes a memory that stores the (n+d) bit extended image data as a lookup table (LUT). The (n+d) bit extended image data is named an offset value. The data extension part 221 according to the present embodiment extends the upper 8 bits of 10 bit current image data into 12 bits and stores the 12 bits therein. The 12 bit extended image data is stored in an address corresponding to a gray scale value of image data. The data extension part 221 outputs the (n+d) extended image data or offset value and an offset difference value corresponding to a difference between an offset value of the cf image data and an offset value of the pf image data. The offset difference value may have a maximum of n+d bits.

The offset value and the offset difference value may be generated or calculated by methods known in the art, and may differ from those describe above depending on the capacity of the data extension part 221.

The interpolation part 223 generates (n+d) bit interpolation data by using the (n+d) bit offset value and the (n+d) bit offset difference value, both outputted by the data extension part 221. The interpolation data is calculated according to a following formula.

$$\text{Interpolation data}=\text{offset value}+\{\text{offset difference value}*\text{fixed data}*(1/2^m)*(2^m-1)/2\} \quad \text{[Formula 1]}$$

In Formula 1, the interpolation data is generated by adding a second term, the expression in the chain brackets, to the offset value. In the second term, the calculation is performed taking into account the use of the m-bit fixed data in the n-bit revision data pf'(n) to reduce the maximum difference between the pf image data and the revision data pf'(n). First, the offset difference value is multiplied by the fixed data, and then multiplied by $1/2^m$ to adjust the number of bits. Multiplication by $1/2^m$ decreases the number of bits of a binary value by m bits. As described above, the maximum difference between the pf image data and the revision data pf' is $\pm(2^m-1)/2$. According to the present embodiment, the fixed data is multiplied by $(2^m-1)/2$ to reduce the difference of the data by 50%.

According to a conventional data processing apparatus, the interpolation data is calculated according to a following formula 2.

Interpolation data=offset value+{offset difference value*lower *m* bit *cf* image data*($1/2^m$)} [Formula 2]

Comparing Formulas 1 and 2, the "lower m bit cf image data", which appears in formula 2, is replaced in Formula 1 by the expression $[1*(2^m-1)/2]$ in which the fixed data corresponding to a decimal value 1 is multiplied by $(2^m-1)/2$. As a result, "fixed data*$(2^m-1)/2$" corresponds to the maximum difference absolute value/2, and an error range of the revision data pf'(n) decreases by a maximum of 50%. For example, if m is 2, "fixed data*$(2^m-1)/2$" in the second term of Formula 1 is 3/2, half of the maximum difference absolute value 3. If m is 3, "fixed data*$(2^m-1)/2$" is 7/2, half of the maximum difference absolute value 7.

Hereinafter, the second term is calculated on the assumption that the offset difference value is a binary value 1000110 and m is 2. If 1000110 is multiplied by a binary value 11 corresponding to a decimal value 3, that is $(2^2-1)$, the result is 11010010. Then, 11010010 is divided by 8, or equivalently multiplied by $1/2^3$ or $(1/2^2*1/2)$, to reduce the number of bits of the binary value. Then, the second term in Formula 1 is 11010.

That is, the interpolation part 223 of the first reviser 220 multiplies the fixed data, generated by the memory interface 210, by the maximum difference absolute value/2 and thus reduces the difference between the pf image data and the pf' revision data by 50%.

The (n+d) bit interpolation data which is outputted by the interpolation part 223 is dithered by the dithering part 225 to provide n-bit image data which is then outputted as first revision image data. The dithering part 225 may dither the interpolation data by various known methods. The scope of the present invention is not limited by a particular dithering method.

Returning to FIG. 3, the first reviser 220 outputs first revision image data and revision data. The pixel 110 includes two sub pixels I and II. The sub pixels I and II receive data voltages based on image data in different levels of a gray scale. The first reviser 220 outputs first revision image data that includes first revision image data for a low gray scale cf'(n) low and first revision image data for a high gray scale cf'(n) high. The first reviser also outputs revision data that includes revision data for a low gray scale pf'(n) low and revision data for a high gray scale pf'(n) high.

The first revision image data is outputted from the first reviser 220 and inputted to the second reviser 230 to be outputted as second revision image data cf''(n) low and cf''(n) high. The second reviser 230 revises the gray scale of the image data by applying overshoot driving or undershoot driving, as appropriate for each frame, to improve a response rate of liquid crystals. That is, the second reviser 230 performs DCC (dynamic capacitance compensation). When the gray scale level of the current frame image data is larger than that of the previous frame image data, overshoot driving applies a data voltage corresponding to a an even higher gray scale level than that of current frame image data to a subpixel electrode in a pixel 110 and thus encourages rapid alignment of liquid crystal molecules. When the gray scale level of the current frame image data is smaller than that of the previous frame image data, undershoot driving applies a data voltage corresponding to an even lower gray scale than that of the current frame image data to the pixel 110 to achieve rapid alignment of the liquid crystal molecules. The larger the gray scale difference between the current frame image data and the previous frame image data, the larger is the overshoot or undershoot revision range.

In particular, if the frequency of the frame image displayed on the liquid crystal panel 100 is 120 Hz and above as in the present embodiment, the overshoot or undershoot revision range increases further in order to change the alignment of the liquid crystal molecules in a shorter time. Under such circumstances, in the conventional data processing apparatus, the difference between the revision data and the previous frame image data may cause the revision range to be extended, leading to image errors.

To solve the foregoing problem, the liquid crystal display apparatus according to the present embodiment replaces the lower m bit image data of the revision data with the fixed data and uses the revision data thus formed to revise the gray scale, and, in revising the color temperature, multiplies by the maximum difference absolute value/2 during the interpolation of the image data to reduce the effect due to the difference between frames of the lower m bit image data.

Figure 6:
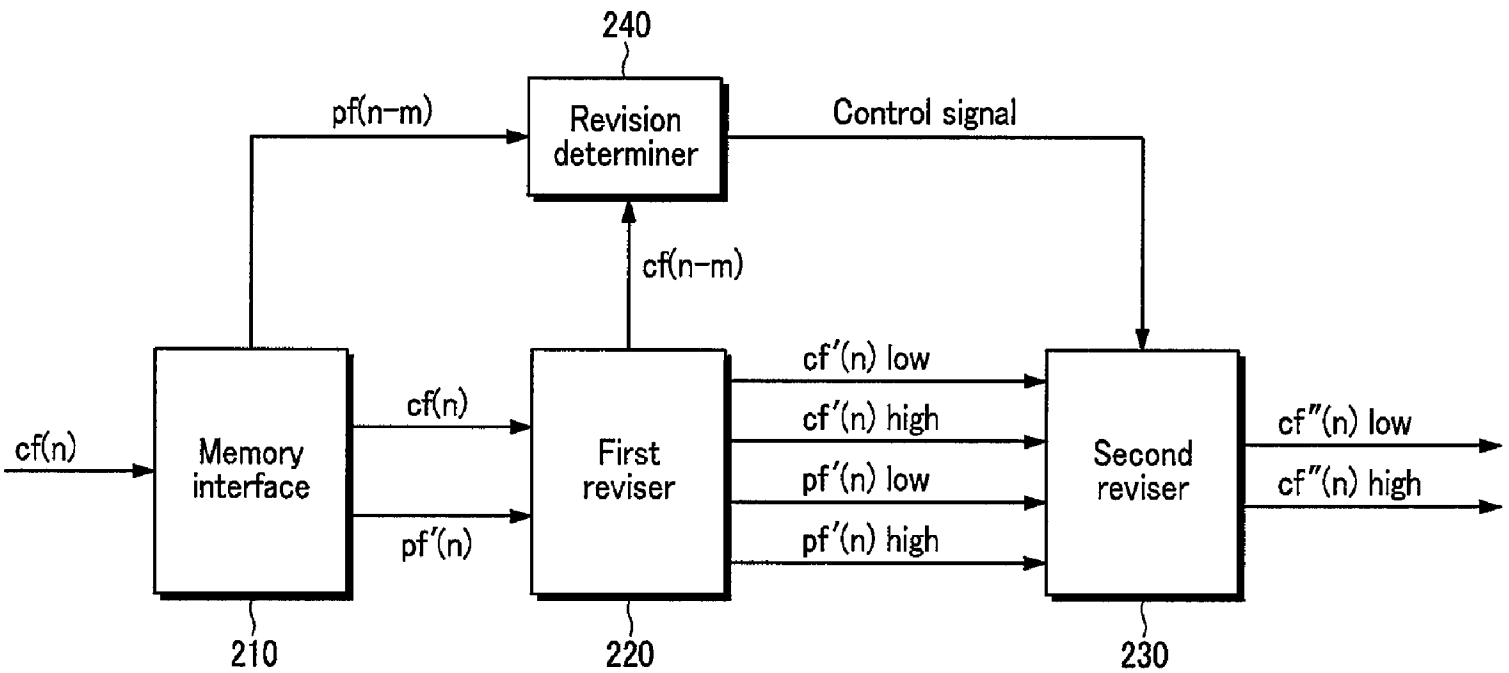
FIG. 6 is a control block diagram of a data processing apparatus according to a second exemplary embodiment of the present invention.

FIG. 6 is a control block diagram of a data processing apparatus for use in revising image data according to a second exemplary embodiment of the present invention.

As shown therein, the data processing apparatus further includes a revision determiner 240. The revision determiner 240 determines whether the upper n−m bits of cf image data cf(n−m) and the upper n−m bits of pf image data pf(n−m) are identical. If it is determined that the upper n−m bits of the cf image data cf(n−m) and the upper n−m bits of the pf image data pf(n−m) are identical to each other, the gray scale needs not be revised. The revision determiner 240 then outputs a control signal to the second reviser 230 to disable the second reviser and prevent the second reviser from performing the gray scale revision. If the upper n−m bits of the cf image data and the upper n−m bits of the pf image data are different, the revision determiner 240 may output an enable control signal to the second reviser 230.

The revision determiner 240 compares the upper (n−m) bits of the original cf frame image data cf(n−m), not the first revision image data revised by the first reviser 220, with the upper (n−m) bits of pf image data pf(n−m), to precisely determine whether the cf image data and the pf image data are identical.

Time delay occurs while the first reviser 220 extends, interpolates and dithers the image data. The revision determiner 240 outputs a control signal to the second reviser 230. The control signal may be synchronized with the first revision image data outputted from the first reviser 220 to the second reviser 230. That is, if the identity or equality of the cf image data to the pf image data is determined to be true, the control signal is stored in a flip flop and outputted together with the first revision data.

Figure 7:
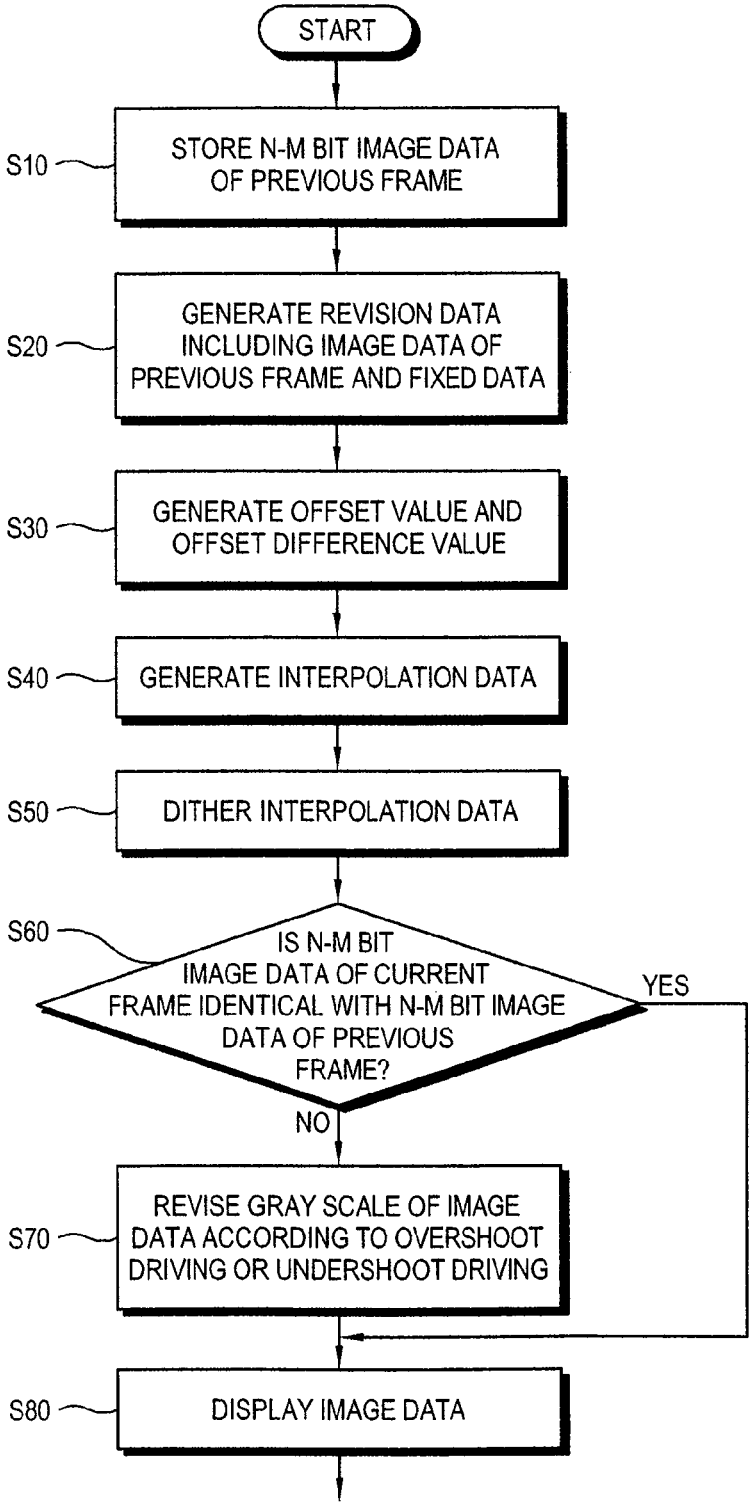
FIG. 7 is a flowchart of a control method of a liquid crystal display apparatus according to the second exemplary embodiment of the present invention.

FIG. 7 is a control flowchart of the liquid crystal display apparatus according to the second exemplary embodiment of the present invention. Referring to FIG. 7, first the upper (n−m) bit image data of a previous frame is stored in the frame memory 300 (S10). The current frame image data is revised by using the previous frame image data stored in the frame memory 300, and the inputted image data is sequentially stored in the frame memory 300 per frame.

The memory interface 210 generates the n-bit revision data having the upper (n−m) bits including (n−m) bit image data of the previous frame outputted by the frame memory 300 and the lower m bits including the fixed data corresponding to the decimal value 1 (S20).

The data extension part 221 of the first reviser 220 generates an offset value having a larger number of bits than n bits from the upper n−m bit image data of the current frame, and stores it as a lookup table. The data extension part 221 generates an offset difference value corresponding to a difference between the offset value of current frame and the offset value of the previous frame (S30).

The interpolation part 223 generates the interpolation data by using the offset value and the offset difference value outputted by the data extension part 221 (S40). The interpolation data is generated according to formula 1.

$$\text{Interpolation data}=\text{offset value}+\{\text{offset difference value}*\text{fixed data}*(1/2^m)*(2^m-1)/2\} \quad \text{[Formula 1]}$$

The dithering part 225 converts the number of bits of the interpolation data into n bits (S50). Then, these n bits, the first revision image data whose color temperature is revised is outputted from the first reviser 220.

While the first reviser 220 calculates the first revision image data, the revision determiner 240 determines whether the n−m bit image data of the current frame and the n−m bit image data of the previous frame are identical (S60). In FIG. 7, for convenience, the identity determination is shown as being performed after the dithering of the interpolation data. That is, according to FIG. 7, the revision determiner 240 finishes the determination after the revision of the first reviser 220 is completed. On the other hand, the revision determiner 240 may make the determination of identity during the time in which control steps S30, S40 and S50 are performed and the control signal generated in step 60 may be synchronized with the output from dithering step S50 as described above in regard to FIG. 6.

If it is determined that the (n−m) bit image data of the current frame and the (n−m) bit image data of the previous frame are not identical to each other, the gray scale of the image data is revised according to the overshoot driving or the undershoot driving (S70). The revised image data is displayed on the liquid crystal panel 100 (S80).

If the n−m bit image data of the current frame and the n−m bit image data of the previous frame are identical to each other, the gray scale revision of the image data is disabled. That is, the image signal bypasses the second reviser 230 and is displayed on the liquid crystal panel 100 (S80).

As described above, the present invention provides a data processing apparatus for revising image data, which apparatus reduces an image error while revising image data, a liquid crystal display apparatus comprising the same and a control method thereof.

Also, the present invention provides a data processing apparatus for revising image data, which apparatus requires memory capacity in a frame memory, a liquid crystal display apparatus comprising the same and a control method thereof.

Further, the present invention provides a data processing apparatus for revising image data, which apparatus prevents an error while revising a gray scale, a liquid crystal display apparatus comprising the same and a control method thereof.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A data processing apparatus which receives n bit image data and provides revised n-bit image data to a data driver, the data processing apparatus comprising:

a frame memory which stores the upper (n−m) bits of n-bit image data of a previous frame;

a memory interface which receives n-bit image data of a current frame, outputs the upper (n−m) bits of the image data of the current frame to the frame memory, receives the upper (n−m) bits of the image data of the previous frame from the frame memory and outputs n-bit revision data including the upper (n−m) bits of the image data of the previous frame and lower m-bit fixed data corresponding to a decimal value 1;

a first reviser which revises a color temperature of the n-bit image data of the current frame, the first reviser receiving the n-bit image data of the current frame and the n-bit revision data and generating first revision image data of the current frame; and a second reviser which revises a gray scale of the image data of the current frame, the second reviser receiving the first revision image data of the current frame from the first reviser and the n-bit revision data, and the second reviser outputting n-bit revised image data of the current frame.

2. The data processing apparatus according to claim 1, wherein the first reviser comprises:

a data extension part which generates an offset value having a number of bits greater than n bits from the upper n−m bits of the image data of the current frame and generates an offset difference value corresponding to a difference between the offset value of the current frame and an offset value of the previous frame;

an interpolation part which generates and outputs interpolation data according to a following formula based on the offset value and the offset difference value;

$$\text{interpolation data}=\text{offset value}+\{\text{offset difference value}*\text{fixed data}*(1/2^m)*(2^m-1)/2\}, \quad \text{[Formula 1]}$$

and a dithering part which converts the interpolation data into n bits and outputs the converted interpolation data as the first revision image data of the current frame.

3. The data processing apparatus according to claim 2, wherein the n bits comprise 10 bits, and the frame memory stores therein 8 bit image data.

4. The data processing apparatus according to claim 3, wherein the number of bits of the offset value comprises 12.

5. The data processing apparatus according to claim 1, further comprising a revision determiner which determines an identity between the upper n−m bits of the image data of the current frame and the upper n−m bits of the image data of the previous frame, and disables the second reviser if it is determined that the upper n−m bits of the image data of the current frame is identical with that of the previous frame.

6. The data processing apparatus according to claim 5, wherein the revision determiner outputs a control signal to the second reviser to control whether to enable the second reviser, and the control signal is synchronized with the first revision image data outputted from the first reviser to the second reviser.

7. The data processing apparatus according to claim 1, wherein the second reviser revises a gray scale of the n-bit image data of the current frame by overshoot driving or undershoot driving.

8. A liquid crystal display apparatus which receives and displays n-bit image data, the liquid crystal display apparatus comprising:

a frame memory which stores the upper n−m bits of n-bit image data of a previous frame;

a data controller which includes a memory interface, the memory interface being configured to output n-bit revision data including the upper n−m bits of the image data of the previous frame from the frame memory and lower m bits fixed data corresponding to a decimal value 1, a first reviser configured to revise a color temperature of the n-bit image data of a current frame by using the n-bit image data of the current frame and the revision data, the first reviser outputting first revision n-bit image date of the current frame, and a second reviser configured to revise a gray scale of the n-bit image data of the current frame by using the first revision n-bit image data of the current frame outputted by the first reviser and the revision data, the second reviser outputting n-bit revised image data of the current frame; and a liquid crystal panel which displays an image based on the n-bit revised image data outputted by the data controller.

9. The liquid crystal display apparatus according to claim 8, wherein the first reviser comprises:

a data extension part which generates an offset value having a number of bits greater than n bits from the upper n−m bits of the n-bit image data of the current frame and generates an offset difference value corresponding to a difference between the offset value and an offset value of the previous frame;

an interpolation part which generates interpolation data according to a following formula based on the offset value and the offset difference value;

$$\text{interpolation data}=\text{offset value}+\{\text{offset difference value}*\text{fixed data}*(1/2^{m})*(2^{m}-1)/2\}, \quad \text{[Formula 1]}$$

and a dithering part which converts the number of bits of the interpolation data into n bits and outputs thy first revision image data of the current frame.

10. The liquid crystal display apparatus according to claim 8, further comprising a revision determiner which compares the upper n−m bits of the image data of the current frame with the upper n−m bits of the image data of the previous frame, and disables the second reviser if it is determined that the upper n−m bits of the image data of the current frame is identical with the upper n−m bits of the image data of the previous frame.

11. The liquid crystal display apparatus according to claim 8, wherein the liquid crystal panel displays thereon 120 frame images per second.

12. The liquid crystal display apparatus according to claim 8, wherein the liquid crystal panel comprises a plurality of pixels, and each pixel is divided by a cutting pattern and comprises a plurality of sub pixels receiving image data in different gray scales.

13. A control method of a liquid crystal display apparatus which receives and displays n-bit image data, the control method comprising:

storing the upper n−m bits of n-bit image data of a previous frame;

generating n-bit revision data, the n-bit revision data including the upper n−m bits of the n-bit image data of the previous frame outputted by a frame memory and lower m bits of fixed data corresponding to a decimal value 1;

revising a color temperature of the n-bit image data of the current frame by using the n-bit image data of a current frame and the revision data, and outputting image data of the current frame having revised color temperature;

revising a gray scale of the n-bit image data of the current frame by using the image data of the current frame having revised color temperature and the revision data, and outputting image data of the current frame having revised color temperature and revised gray scale; and displaying image data having revised color temperature and revised gray scale.

14. The control method according to claim 13, wherein the revising the color temperature comprises:

generating an offset value having a larger number of bits than n bits from n−m bit image data of the current frame;

generating an offset difference value corresponding to a difference between the offset value and an offset value of the previous frame;

generating interpolation data according to a following formula based on the offset value and the offset difference value;

$$\text{interpolation data}=\text{offset value}+\{\text{offset difference value}*\text{fixed data}*(1/2^{m})*(2^{m}-1)/2\}, \quad \text{[Formula 1]}$$

and converting the number of bits of the interpolation data into the n-bit image data of the current frame having revised color temperature.

15. The control method according to claim 13, further comprising:

determining an identity between upper n−m bits of the image data of the current frame and the upper n−m bits of the image data of the previous frame; and revising the gray scale of the image data of the current frame if it is determined that the upper n−m bits of the image data of the current frame is different from the upper n−m bits of the image data of the previous frame.

16. The control method according to claim 13, wherein revising the gray scale comprises overshoot driving or undershoot driving.

* * * * *